US006039222A

United States Patent [19]

Smith

[11] Patent Number: 6,039,222

[45] Date of Patent: Mar. 21, 2000

[54] VAPOR PERMEABLE PRESSURIZED PACKAGE

[75] Inventor: Scott E. Smith, Cincinnati, Ohio

[73] Assignee: The Procter & Gamble Co., Cincinnati, Ohio

[21] Appl. No.: 08/802,476

[22] Filed: Feb. 18, 1997

[51] Int. Cl.[7] ..... B67D 5/42

[52] U.S. Cl. ..... 222/386; 222/394

[58] Field of Search ..... 222/394, 386, 222/402.1

[56] References Cited

U.S. PATENT DOCUMENTS

| | | | |
|---|---|---|---|
| 2,950,846 | 8/1960 | Clark et al. | 222/399 |
| 3,258,163 | 6/1966 | Brush | 222/52 |
| 3,273,762 | 9/1966 | O'Neill, Jr. | 222/389 |
| 3,322,304 | 5/1967 | Wilson | 222/52 |
| 3,460,555 | 8/1969 | Puster | 137/12 |
| 3,613,954 | 10/1971 | Bayne | 222/61 |
| 3,708,089 | 1/1973 | Holder et al. | 222/396 |
| 3,815,793 | 6/1974 | Morane et al. | 222/399 |
| 3,915,352 | 10/1975 | Scheindel | 222/389 |
| 3,955,720 | 5/1976 | Malone | 222/396 |
| 4,147,283 | 4/1979 | Mascia et al. | 222/399 |
| 4,310,108 | 1/1982 | Motoyama et al. | 222/396 |
| 4,441,632 | 4/1984 | Stoody | 222/129 |
| 4,456,155 | 6/1984 | Miyata et al. | 222/396 |
| 4,995,533 | 2/1991 | Vandoninck | 222/54 |
| 5,011,047 | 4/1991 | Cruysberghs | 222/396 |
| 5,056,690 | 10/1991 | Ichihara et al. | 222/386 |
| 5,090,595 | 2/1992 | Vandoninck | 222/54 |
| 5,110,014 | 5/1992 | Doundoulakis | 222/396 |
| 5,133,701 | 7/1992 | Han | 604/289 |
| 5,277,336 | 1/1994 | Youel | 222/105 |
| 5,368,207 | 11/1994 | Cruysberghs | 222/396 |
| 5,522,526 | 6/1996 | DeLaforcade et al. | 222/1 |

FOREIGN PATENT DOCUMENTS

| | | |
|---|---|---|
| 0 732 273 | 9/1996 | European Pat. Off. . |
| 0 732 276 | 9/1996 | European Pat. Off. . |
| 370458 | 2/1907 | France . |
| 1399246 | 4/1965 | France . |
| 2 277 938 | 2/1976 | France . |
| 2639-920 | 6/1990 | France . |
| 3624638 | 2/1988 | Germany . |
| 90/15377 | 12/1990 | WIPO . |
| WO93/10022 | 5/1993 | WIPO . |

*Primary Examiner*—Gregory L. Huson
*Attorney, Agent, or Firm*—Jack L. Oney Jr.

[57] ABSTRACT

A vapor permeable pressurized package is disclosed. The package includes a container defining an interior space and a partition dividing the interior space of the container into a first compartment for storing a product to be dispensed from the container and a second compartment for storing a propellant employed to selectively force the product through the outlet of the container. The partition includes pores selectively permitting propellent vapor to pass from the second compartment to the first compartment. The propellant vapor stored in the second compartment moves into the first compartment when the container is actuated for the release of the product stored in the first compartment, causing the product to be expelled through the outlet of the container.

2 Claims, 4 Drawing Sheets

VAPOR PERMEABLE PRESSURIZED PACKAGE

BACKGROUND OF THE INVENTION

1. Field of the Invention

The invention relates to pressurized packages. More particularly, the invention relates to a pressurized package wherein the product and propellant reservoirs are separated by a vapor permeable piston or membrane.

2. Description of the Prior Art

Pressurized packages employed in dispensing materials are well known, and are utilized to dispense a wide variety of products. These packages require that a liquefied propellant be incorporated within the package to force the product from the interior space defined by the container. Unfortunately, this dictates that the liquefied propellant be intimately associated and dispensed with the product, whether the propellant is mixed with the product or the propellant and product remain separate (fractionated).

In many applications, it is perfectly acceptable to mix the product with the propellant. However, the nature of these packages requires that a substantial amount of propellant be consumed. In addition, formulations and packages are inherently limited by the manner in which the product and the propellant may be composed.

Where it is unacceptable to mix the product and the propellant, pistons have been positioned between the product and the propellant. In these packages, the propellant creates pressure under the piston, which forces the piston up to create pressure on the product and thereby force it through the outlet of the package. Unfortunately, while the inclusion of the piston separates the propellant from the product, many of the advantages associated with contacting the product with the vapor of the propellant are forfeited.

After reviewing prior pressurized packages, it is apparent that a need exists for a package permitting a user to separate the product from the propellant, while still reaping the advantages associated with contacting the product with the vapor of the propellant; one advantage being the creation of a pressure head to allow discharge of product. The present invention provides such a package.

SUMMARY OF THE INVENTION

It is, therefore, an object of the present invention to provide a vapor permeable pressurized package. The package includes a container defining an interior space and a partition (disc or membrane) dividing the interior space of the container into a first compartment for storing a product to be dispensed from the container and a second compartment for storing a propellant employed to selectively force the product through the outlet of the container. The disc includes pores selectively permitting propellent vapor to pass from the second compartment to the first compartment. The propellant vapor stored in the second compartment moves into the first compartment when the container is actuated for the release of the product stored in the first compartment, causing the product to be expelled through the outlet of the container.

It is an object of the present invention to provide for more efficient use of propellant in spray packages.

It is also an object of the present invention to provide a package wherein the disc is axially moveable within the container.

It is another object of the present invention to provide a package wherein the disc is fixedly held within the container.

It is a further object of the present invention to provide a package wherein the disc includes a single central opening though which the vapor of propellant may pass.

It is also an object of the present invention to provide a package wherein the disc includes multiple pores through which the vapor of the propellant may pass.

It is another object of the present invention to provide a package including a dip tube secured to the actuator, wherein the dip tube has a free end within the first compartment in which product and propellant vapor enters as the product and the propellant vapor are dispensed from the container.

It is a further object of the present invention to provide a package wherein the free end of the dip tube is positioned adjacent the central opening, and the free end of the dip tube and the central opening are covered by a fitment which directs the propellant vapor into the free end of the dip tube and prevents the passage of product into the free end of the dip tube. The dip tube is further provided with a hole through which the product enters the dip tube for discharge.

It is also an object of the present invention to provide a package including a one way check valve positioned adjacent the disc and within the second compartment. The check valve is oriented to prevent the flow of product from the first compartment into the second compartment, while permitting the flow of vapor of the propellant from the second compartment to the first compartment.

It is another object of the present invention to provide a package including an extension member positioned adjacent the disc and within the second compartment. The extension member including a downwardly extending tube which prevents the flow of liquid propellant from the second compartment and into the first compartment.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
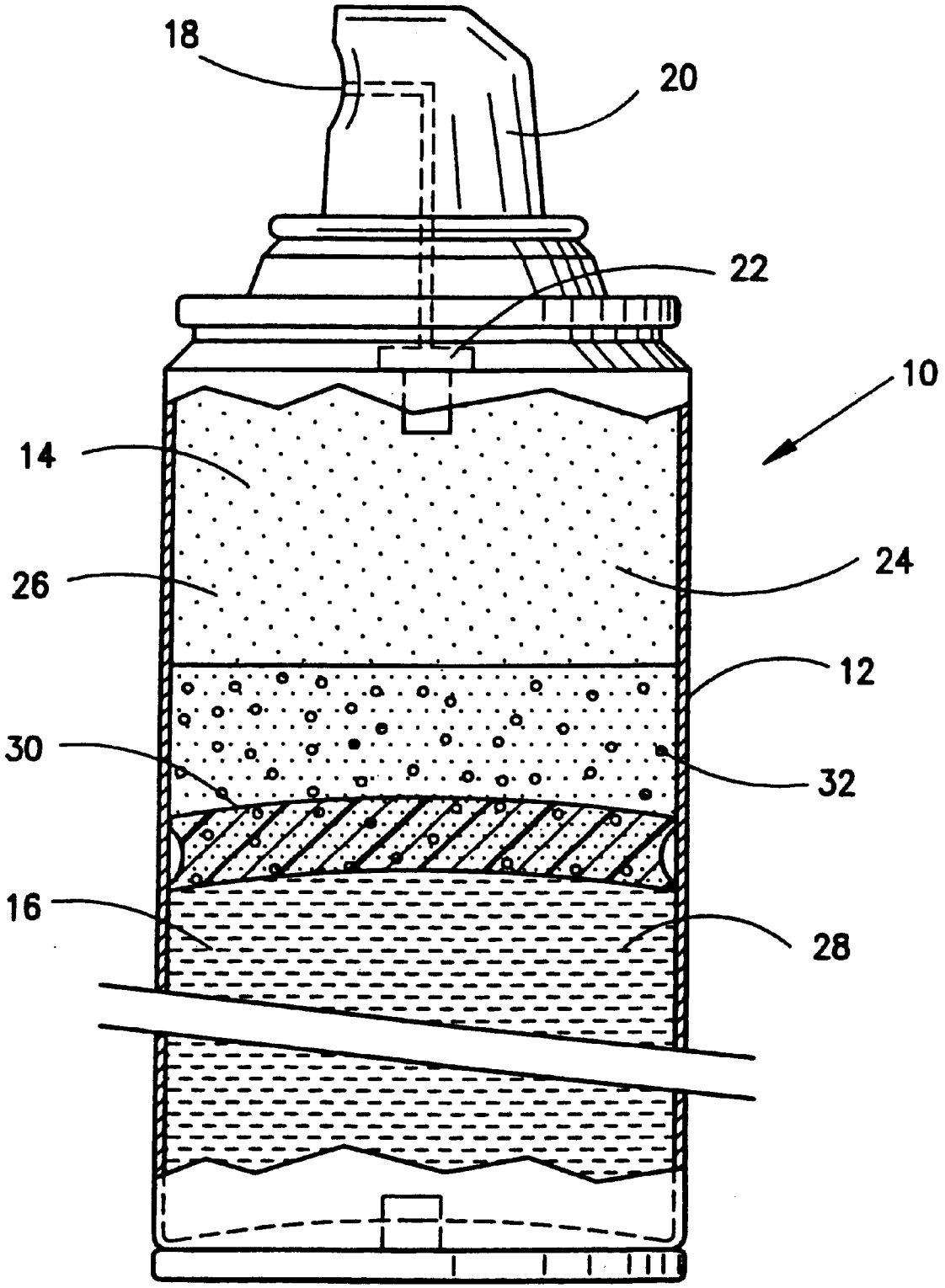
FIG. 1 is a cross sectional view of a first embodiment of the present invention showing the product and propellant.

With reference to FIG. 1, a first embodiment of the present package 10 is disclosed. The package 10 is a vapor permeable pressurized package and includes a container 12 in which the product 14 to be dispensed and the propellant 16 are stored. As with conventional pressurized packages, the container is provided with an outlet 18 through which the product 14 is dispensed. Dispensing of the product is controlled by a push button actuator 20 and valve 22. The product may be stored in either chamber, with the propellant in the opposite chamber; where the product is stored in the lower chamber, a dip tube would be connected to the actuator and would run down through the partition into the lower chamber to allow product to be dispensed.

The container 12 defines an interior space 24 which is divided into a first compartment 26 and a second compartment 28. Specifically, a porous disc 30 divides the interior space 24 of the container 12 into a first compartment 26 containing a product 14 to be dispensed from the container and a second compartment 28 containing a propellant 16 employed to selectively force the product 14 through the outlet 18 of the package 10. Both the product 14 and the propellant 16 may be chosen from a variety of commonly used materials, and the present invention is not intended to be limited to specific formulations of the product or propellant. In fact, the present package may be used to dispense liquids, powders, heavy emulsions, and other products, without departing from the spirit of the present invention. In any case, the vapor phase of the propellant is employed as the driving force for both dispensing of the product, as well as atomization of the product.

The porous disc 30 includes pores selectively permitting propellant vapor 32 of the propellant 16 to pass from the second compartment 24 to the first compartment 28. The propellant vapor 32, originally stored in the second compartment 28, moves into the first compartment 26 when the package 10 is actuated. Movement of the vapor within the first compartment 26 creates pressure causing the product 14 to be expelled through the outlet 18.

Specifically, the propellant 16 is charged in the second compartment 28 to pressurize the entire system. When the valve 22 is actuated by an individual pressing on the actuator 20, the propellant 16 boils due to the pressure change, thereby releasing the propellant vapor 32. The released propellant vapor 32 passes through the porous disc 30 and into the first compartment 26 where the product 14 is stored. As the propellant vapor 32 passes through the porous disc 30, the product 14 in the first compartment 26 is fluidized. The propellant vapor 32 then regenerates the headspace (that is, creates pressure within the container causing the discharge of the product) and the product is dispensed through the outlet 18. The product 14 can thereby be sprayed like a common aerosol.

In the embodiment shown in FIG. 1, the porous disc 30 may be fixed in position or it may move within the container 12, and a diptube may or may not be used in either embodiment. When a diptube is used with a movable disc, the diptube must be collapsible, foldable, or sealingly slidable with respect to the disc. Where the disc 30 is fixed in position, the propellant vapor 32 is the sole force employed in dispensing the product 14 from the first compartment 26. Where the disc 30 is moveable within the container 12, the force generated by the boiling of the propellant 16 will force the disc 30 upward within the container 12 to create additional pressure on the product 14 stored within the first compartment 26. The additional pressure created by the disc 30 moving upward within the container 12 works in conjunction with the propellant vapor 32 to dispense the product 14 from the first compartment 26. A porous flexible bag, within container 12, may be employed instead of a porous disc or membrane. The bag would contain the product, and the propellant would be contained between the outside of the bag and the inside of container 12. The end result would be substantially the same as with use of a disc or membrane.

Figure 2:
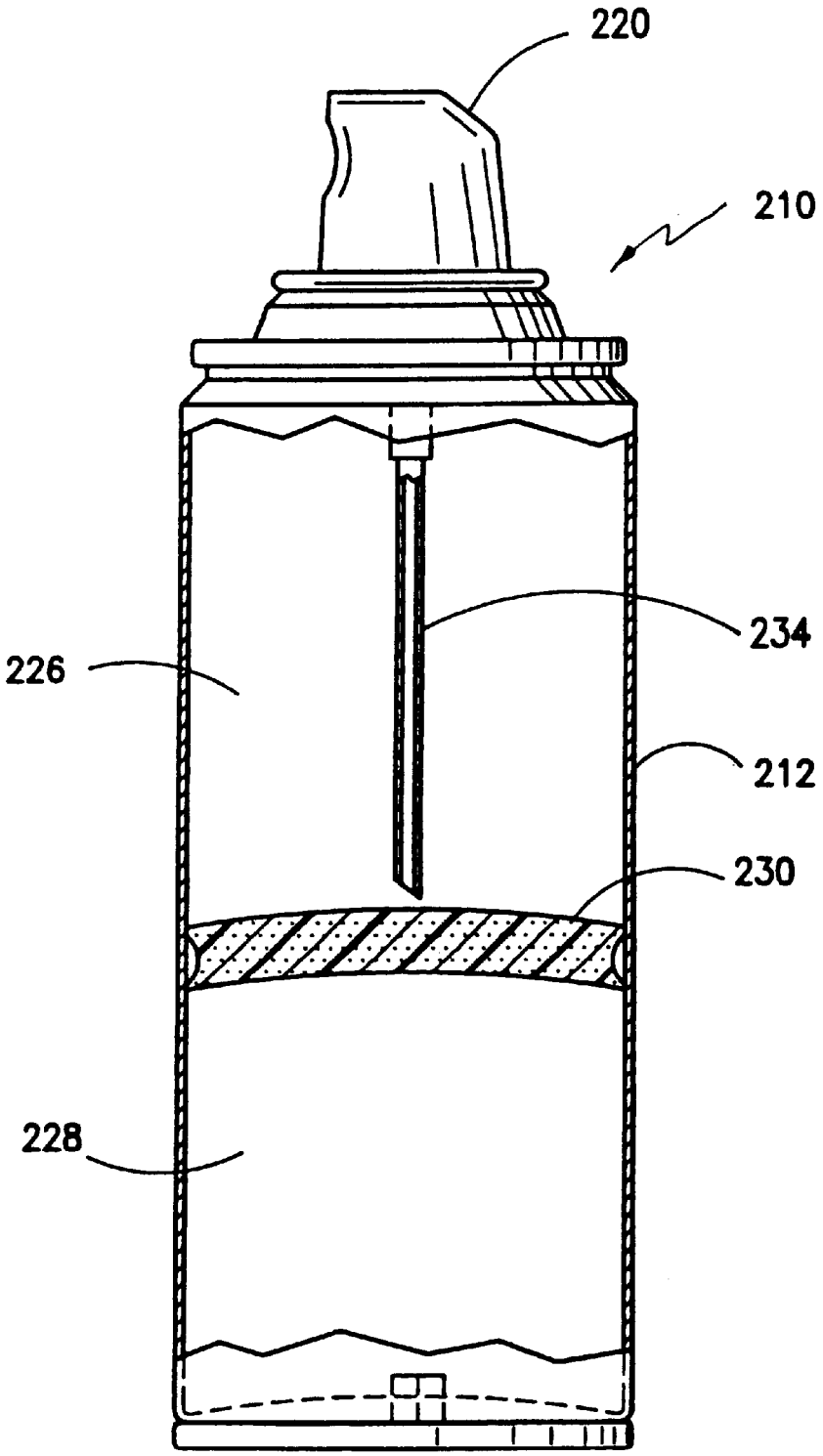
FIG. 2 is a cross sectional view of a second embodiment of the present invention.

With reference to FIG. 2, a second embodiment 210 of the present invention is disclosed. This embodiment includes a porous disc 230 fixedly held within the container 212 to define the first compartment 226 and the second compartment 228. The package 210 is also provided with a dip tube 234 through which the product and the propellant vapor may exit together when the actuator 220 of the package 210 is actuated. Additionally in this embodiment, vapor may be drawn from the head space.

Figure 3:
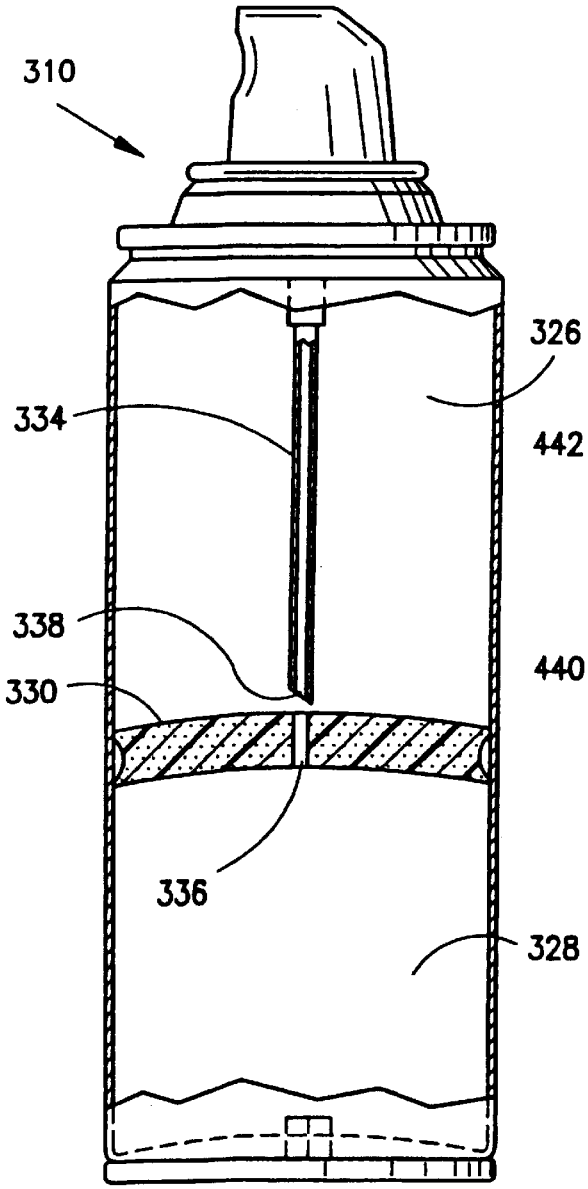
FIG. 3 is a cross sectional view of a third embodiment of the present invention.

With reference to FIG. 3, a third embodiment 310 of the present invention is disclosed. The third embodiment is substantially similar to the embodiment disclosed in FIG. 2, but the disc 330 of the third embodiment is provided with a single central opening 336 through which the propellant vapor may pass. As such, the free end 338 of the dip tube 334 is located adjacent the central opening 336 found in the disc 330.

In accordance with the preferred embodiment of the present invention, the central opening 336 is a porous section designed to permit the passage of the propellant vapor therethrough but prevent the liquid propellant in the second compartment 328 from passing into the first compartment 326 and mixing with the product stored therein. This embodiment is envisioned as being useful where it is necessary to break up the product in a desirable manner. As such, the action of the propellant vapor and the product moving into the dip tube 334 breaks up the product to enhance the discharge of the product.

Figure 4:
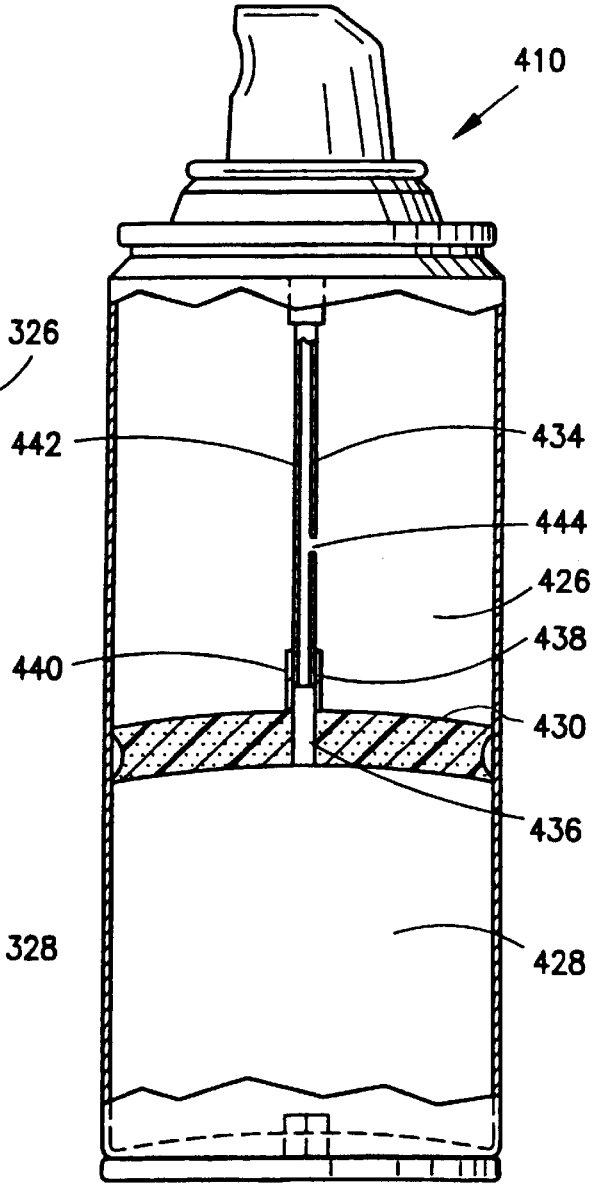
FIG. 4 is a cross sectional view of a fourth embodiment of the present invention.

With reference to FIG. 4, a fourth embodiment 410 of the present invention is disclosed. The fourth embodiment includes a fixed disc 430 separating the propellant contained in the second compartment 428 from the product contained within the first compartment 426. The disc 430 is provided with a central opening 436 through which the propellant vapor may pass to assist in the discharge of the product from the package 410. As with the third embodiment, the central opening 436 is a porous section designed to permit the passage of the propellant vapor therethrough but prevent the liquid propellant from passing into the first compartment 426 where the product is stored. With the exception of the central opening 436 the disc 430 is impermeable to both the liquid propellant and the propellant vapor.

The fourth embodiment is also provided with a dip tube 434 having a free end 438 adjacent the central opening 436, wherein the free end 438 of the dip tube 434 is covered by a fitment 440. The fitment 440 directs the propellant vapor into the dip tube 434 when the package 410 is actuated to dispense the product. Since the free end 438 of the dip tube 434 is encased within the fitment 440 and product is prevented from entering the free end 438 of the dip tube 434, the wall 442 of dip tube 434 is provided with a hole 444 through which the product enters the dip tube 434. In use, movement of the propellant vapor within the dip tube 434 creates suction at the hole 444. The suction draws the product into the cavity defined by the dip tube 434 such that it may be discharged from the package 410 with the propellant vapor. It should be understood that the size, shape, and location of the hole within the wall of the dip tube may be varied to suit the propellant, the product, and the desired discharge rate without departing from the spirit of the present invention.

Figure 5:
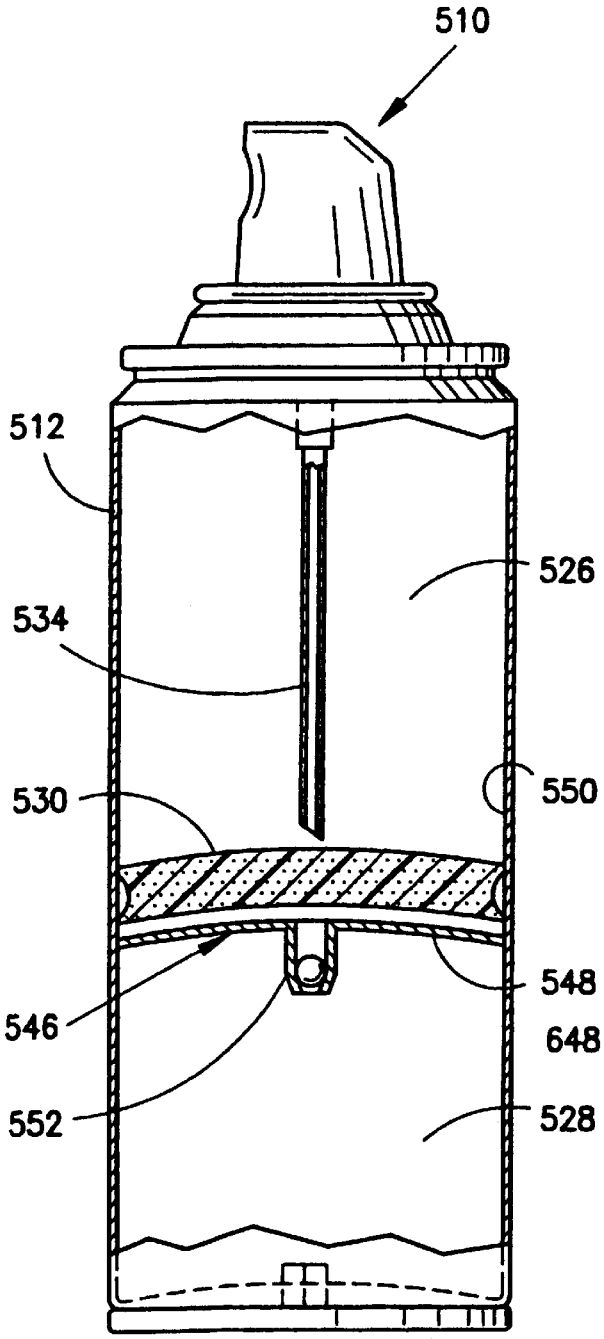
FIG. 5 is a cross sectional view of a fifth embodiment of the present invention.

With reference to FIG. 5, a fifth embodiment 510 of the present invention is disclosed. The fifth embodiment includes a porous disc 530 and a dip tube 534 in much the same manner as the second embodiment disclosed in FIG. 2. However, the fifth embodiment is also provided with a check valve arrangement 546 to stop any product contained in the first compartment 526 from passing though the porous disc 530 and into the second compartment 528. The embodiment of FIG. 5 can be utilized with or without a diptube; without a diptube, the piston may be movable.

As shown, the check valve arrangement 546 is mounted within the container 512 just below the porous disc 530. The check valve arrangement 546 includes a shroud 548 supported on the interior wall 550 of the container 512. The shroud 548 supports a check valve 552 oriented to permit the flow of the propellant vapor toward the first compartment 526, but prevent the flow of product into the second compartment 528. The check valve 552 may be a spring loaded one way check valve or a gravity loaded one way check valve.

Figure 6:
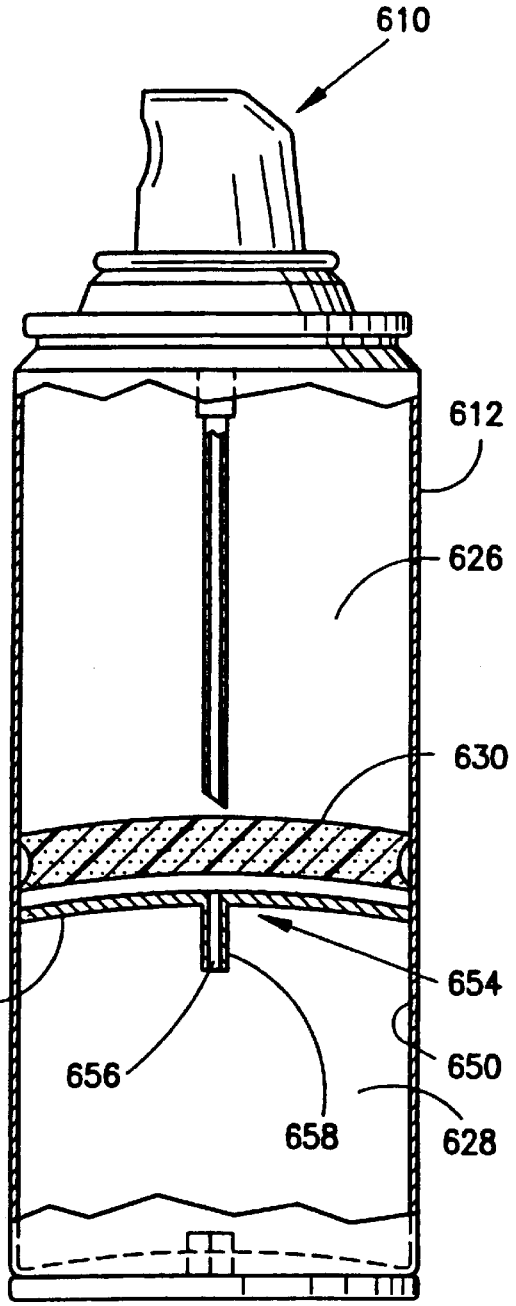
FIG. 6 is a cross sectional view of a sixth embodiment of the present invention.

With reference to FIG. 6, a sixth embodiment 610 of the present invention is disclosed. The sixth embodiment includes a fixed porous disc 630 dividing the container into a first compartment 626 and a second compartment 628. The package 610 is provided with an extension 654 mounted just below the porous disc 630 and within the second compartment 628. The extension 654 includes a shroud 648 mounted on the interior wall 650 of the container 612. The shroud 648 includes a central opening 656 defined by a downwardly extending tube 658. The extension prevents the flow of liquid propellant into the first compartment 626 if the package were to be stored on its side, or upside down. The embodiment of FIG. 6 can be utilized with or without a diptube; without a diptube, the piston may be movable.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A spray package, comprising:

a container having an outlet and defining an interior space;

a partition dividing the interior space of the container into a first compartment for storing a product to be dispensed from the container and a second compartment for storing a propellant employed to selectively force the product through the outlet of the container;

the partition including pores selectively permitting a propellant vapor to pass from the second compartment to the first compartment, wherein a propellant vapor stored in the second compartment moves into the first compartment when the container is actuated for dispensing of the product stored in the first compartment, wherein the partition is axially moveable within the container.

2. A vapor permeable pressurized package, comprising:

a container including an outlet and defining an interior space;

a disc dividing the interior space of the container into a first compartment containing a product to be dispensed from the container and a second compartment containing a propellant employed to selectively force the product through the outlet of the container;

the disc including pores selectively permitting propellant vapor to pass from the second compartment to the first compartment, wherein the propellant vapor stored in the second compartment moves into the first compartment when the container is actuated for dispensing of the product stored in the first compartment, causing the product to be expelled through the outlet of the container, wherein the disc is axially moveable within the container.

* * * * *